United States Patent [19]

Thomas

[11] 4,108,034

[45] Aug. 22, 1978

[54] SNAP CUTTER APPARATUS FOR PAPER TUBES

[75] Inventor: Anthony Vincent Thomas, Prospect Heights, Ill.

[73] Assignee: Precision Paper Tube Company, Wheeling, Ill.

[21] Appl. No.: 806,106

[22] Filed: Jun. 13, 1977

[51] Int. Cl.[2] ..... B26D 3/16

[52] U.S. Cl. ..... 83/361; 83/365; 83/372; 83/587; 83/593

[58] Field of Search ..... 83/361, 362, 365, 372, 83/370, 586, 593, 592, 288, 289, 208–212, 364, 587; 200/61.13, 61.14, 61.19, 61.41, 61.42, 61.53, 61.02; 250/548, 206; 93/80

[56] References Cited

U.S. PATENT DOCUMENTS

| | | | |
|---|---|---|---|
| 1,318,320 | 10/1919 | Frohn | 83/593 X |
| 1,724,068 | 8/1929 | Brackett et al. | 83/593 X |
| 1,900,252 | 3/1933 | Morgan | 83/288 |
| 2,168,203 | 8/1939 | Green | 83/289 X |
| 2,211,362 | 8/1940 | Bennett | 83/287 X |
| 3,114,282 | 12/1963 | Reifenhauser et al. | 83/370 X |
| 3,139,011 | 6/1964 | Glasby | 83/370 X |
| 3,143,908 | 8/1964 | Schildt et al. | 83/372 X |

*Primary Examiner*—Frank T. Yost

*Attorney, Agent, or Firm*—Tilton, Fallon, Lungmus & Chestnut

[57] ABSTRACT

Tubes made from spirally wound paper tape are fed axially and suspended off the end of an arbor. When the tube reaches a predetermined length, the free end engages a free-hanging sensor plate, the movement of which interrupts a light beam to generate a signal which actuates a timer. The timer energizes a motor for a predetermined time to cycle a snap cutter through one circular orbit to sever the tube. The cutter is stopped at its original position by a brake.

5 Claims, 6 Drawing Figures

SNAP CUTTER APPARATUS FOR PAPER TUBES

BACKGROUND AND SUMMARY

The present invention relates to cutter apparatus for use in cutting paper tubes. These tubes are made from spirally wound paper tape. During their manufacture, they are fed axially along an arbor, and when the tube reaches a sufficient length, it is desirable to cut the tube. Such tubes have many different uses in various industries. For example, in the electronics industries, paper tubes are used as coil forms.

In order to facilitate cutting of the paper tubes, the tubes are normally pulled off the arbor after forming, and they are suspended or cantilevered off the end of the arbor so that a saw or cutting element does not strike the arbor during cutting.

For tubes of larger size, there is enough rigidity in the tube itself to trip a switch or otherwise actuate the cutter mechanism. However, for tubes of smaller diameter with thin walls (for example, ½ in. or smaller in diameter and 0.005 in. or less wall thickness), the length of tubes suspended off the arbor may reach 30–36 inches, and the tube has a tendency to wobble or vibrate. It is therefore difficult to actuate a switch or to sense the end of the tube optically (especially in the case of clear tubes), as is sometimes done in the case of larger, more rigid tubes.

Another problem with tubes of smaller size is that it is difficult and uneconomical to cut them with saw blades, and conventionally, a cutter blade is actuated cyclically, and independently of the feed rate of the tubes. Any variation in the cycle rate of the cutter or the feed rate of the tubes, or both, will result in variations in tube length, and this produces larger waste since the tubes are normally cut at a longer length during manufacture, and then cut to the ultimate desired length after shipment at the longer length.

According to the present invention, a sensor plate of large area but light in weight is arranged in a plane transverse of the axial direction of the tube, and adapted to be engaged by the suspended free end of the tube. The area of the plate is large enough so that even if the free end moves or vibrates, it will not escape engagement with the sensor plate. A support which drops away when the tube is cut helps hold the tube in place prior to and during cutting.

When the sensor plate is engaged by the tube, further movement of the tube will cause the free-hanging plate to interrupt a light beam to generate a signal which energizes a motor and also actuates a timer. The timer is set to time out in a predetermined time less than a complete cycle of a snap cutter. When the timer times out, the motor is disengaged, and it is a braking motor so that it stops almost immediately. However, an overriding directional clutch is inserted between the shaft driven by the motor and the cutter knife so that the cutter knife is free to complete its cycle and is returned to its original position where a cam stops it. Thus, the system is ready for a next cut.

The cutter blade is spring-mounted on an arm secured to a disc which is driven through a complete cycle when the motor is energized. When the cutter blade rides over the stop cam and clears it, the spring causes the cutter blade to accelerate substantially, thereby effecting a clean, sharp cut of the tube. After the cutter cleans the tube (approximately 200 angular degrees of rotation of the disc), the timer deenergizes the motor, and the inertia of the disc causes the overriding clutch to return the cutter blade to its initial position.

The present invention thus provides a convenient, economical and reliable snap cutter useful in the production of paper tubes of small sizes.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
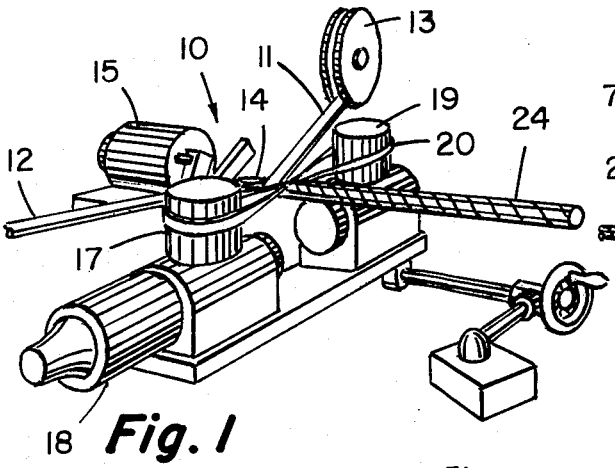
FIG. 1 is a perspective view of apparatus used in the production of paper tubes.

Referring first to FIG. 1, reference numeral 10 generally designates a winding station in which individual tapes 11, 12 are fed from source rolls (such as that shown in 13) at predetermined angles, and wound on an arbor 14 driven by a motor 15. A puller mechanism including a standard 17 driven by a motor 18 and an idler standard 19 driven by a belt 20 and wound around the forming tapes pulls the tube along the arbor, the finished tube being designated 24. The tubes are held together by means of adhesive, as is well known in this art. Because the feed tapes 11, 12 are inclined at an angle relative to the axis of the arbor 14, the resulting tube 24 is comprised of spirally wound, adhesively secured paper tapes.

Figure 2:
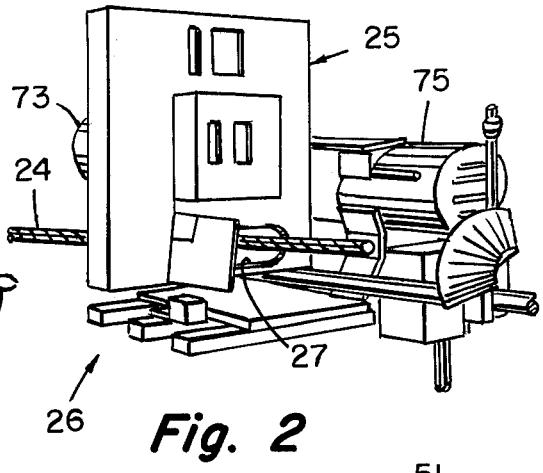
FIG. 2 is a perspective view of a cutter device incorporating the present invention.

Turning now to FIG. 2, the tube 24 is fed to a cutter station generally designated by reference numeral 26, the cutter being housed in a cabinet 25 for safety. The tube 24 is fed entirely through the housing 25, exiting through an aperture 27. The tube is being fed from left to right in FIG. 2.

Figure 5:
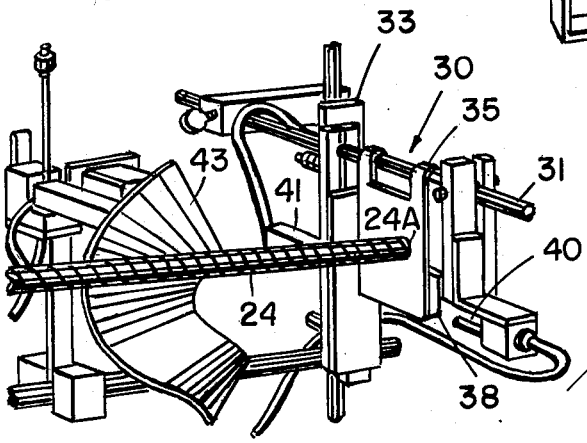
FIG. 5 is a perspective view taken upstream, of the cutter trip apparatus.

From the cutting station 26, the tube is fed, as seen in FIG. 5 to a sensing station generally designated by reference numeral 30. At the sensing station 30, a rod 31 is mounted above the tube 24 and extending transverse of its direction of travel (which is axially of the tube). The rod 31 is secured to a frame 33; and a lightweight sensor plate 35 is mounted in a free-hanging fashion from the rod 31. By "free-hanging" is meant that it is suspended so as to freely move along the direction of travel of the tube. It will be observed that the sensor plate 35 has substantial length and width in comparison with the diameter of the tube 24. This insures that even though the free end 24A of the tube 24 may wobble substantially, it will nevertheless ultimately engage the sensor plate 35 and move it toward the right rear in FIG. 5. Mounted behind the sensor plate 35 is a flag 38; and to the side there is mounted a light source 40 adapted to generate a beam of light sensed by a photodetector 41 on the other side of the flag 38. When the sensor plate 35 is moved rearwardly in response to the forward motion of the free end 24A of the tube, the flag 38 will interrupt the beam of light, thereby generating a signal to actuate the cutter, as will be described presently. In FIG. 5, reference numeral 43 designates a curved shield to guide the tube 24 into the plate 35 and to protect it against interference with the remainder of the apparatus. When the tube is cut, the shield drops away as the tube falls, to guide it into a collection bin.

Figure 3:
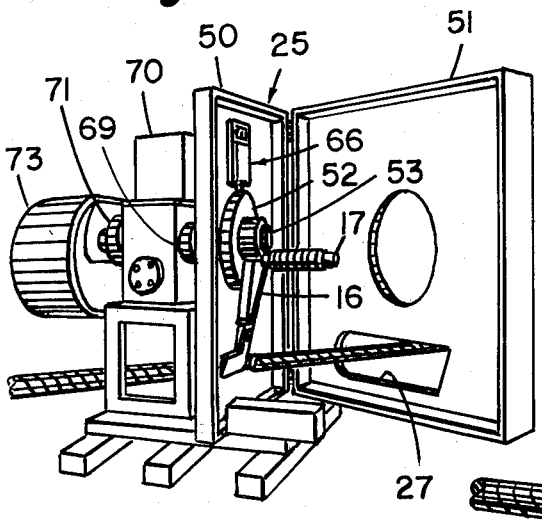
FIG. 3 is a perspective view similar to that of FIG. 2 but moved approximately 30° to the left, and with the cutter housing opened.
Figure 4:
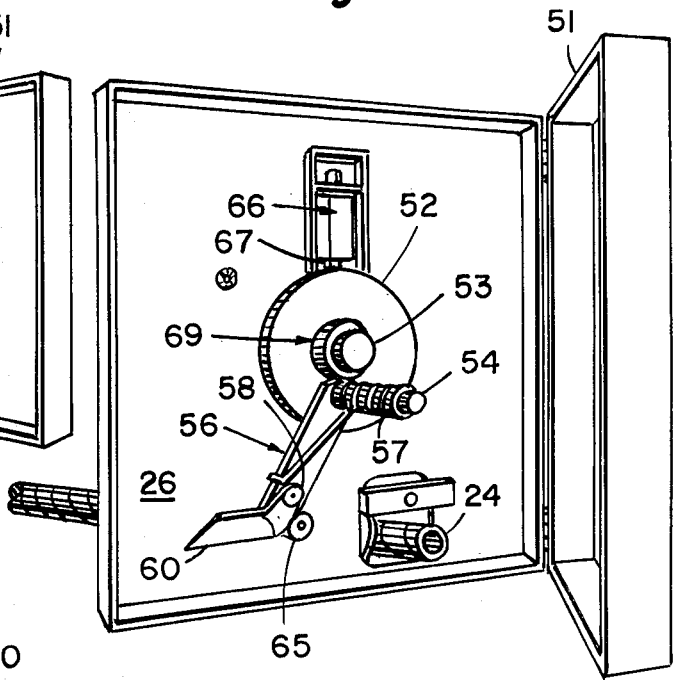
FIG. 4 is a close-up view taken from a position similar to that of FIG. 2, with the cutter housing opened.

Referring now to the cutter station in particular, as best seen in FIGS. 3 and 4, the cabinet 25 includes a fixed enclosure 50 and a hinged cover 51. Within the enclosure 50 is a disc 52 which is mounted to a shaft 53 by means of an overriding directional clutch 69. The disc also carries a stub shaft 54. When the shaft 53 is driven (counterclockwise in FIG. 4) the clutch 69 engages, and the disc 52 rotates while the stub shaft 54 orbits about in a circular manner. A cutter knife 56 is pivotally mounted to the shaft 54, and it is preloaded to a forward position by means of coil spring 57 which is received on the stub shaft 54 and includes an extension 58 which is secured to the knife 56. A blade 60 is mounted to the end of the knife; and in the rest position shown in FIG. 4, the knife engages a stop cam 65 mounted to the enclosure 50.

Also mounted within the housing is an adjustable friction brake 66 having a friction arm 67 which engages the disc to apply a constant drag. This helps control the stopping of the knife by the stop cam 65.

The shaft 53 which forms the input to the overriding clutch 69, extends out of the rear of the housing 25 and is driven by a pulley and belt 71 protected by a shield 73. The belt is driven through a right angle connection by an electric motor 75 (FIG. 2). The motor 75 has a spring-actuated, self-contained brake; and when power is supplied to the motor, the same signal releases the brake. When power is removed from the motor terminal, the brake is actuated by the spring so that the motor stops almost immediately. This is referred to as a "braking motor" in this application.

The power to the motor is supplied through a timer 70 for a predetermined time which is less than the time required for a complete cycle of the knife.

Figure 6:
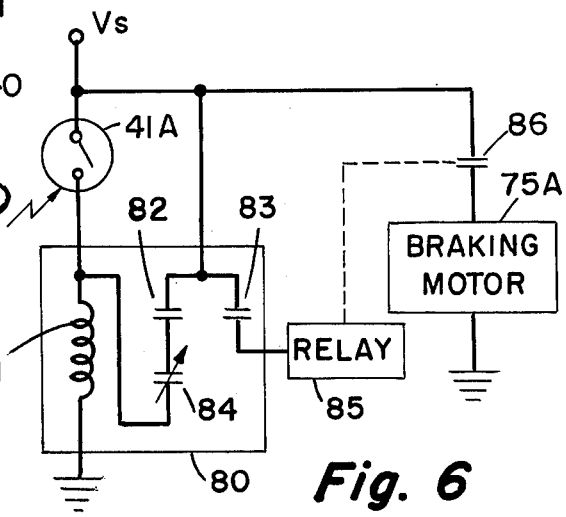
FIG. 6 is a schematic diagram of the control circuitry for the cutter.

Turning now to FIG. 6, the timer is enclosed within the solid block 80, and it includes a coil 81, first and second pairs of normally open contacts 82, 83, and a pair of normally closed contacts 84. The contacts 82, 83 are actuated immediately when the coil is energized, and the contacts 84 are actuated (that is, opened) after the preset time. The coil 81 is connected in series with the photocell, shown at 41A. The contacts 83 are connected in series with the coil of a relay 85 having a pair of normally open contacts 86 connected in series with the braking motor, shown at 75A.

OPERATION

As the motor 15 drives the arbor, the tapes are pulled about it in spiral fashion, and the belt 20 pulls the tapes axially of the arbor through the cutter station 25 to the sensor station 30. The arbor terminates prior to the cutter station.

When the free end 24A (FIG. 5) engages the sensor plate 35, it is moved rearwardly, and the flag 38 interrupts the beam from the source 40. The sensor 41 thereupon generates a signal to actuate the timer 70 by energizing the coil 81.

As soon as the coil 81 of the timer is energized, contacts 82 and 83 close. Contacts 82 supply a sustaining current through normally closed contacts 84 to the coil 81 of the timer. Contacts 83 supply current to the relay 85 which, when it closes, actuates the braking motor through contacts 86. When the motor starts, the shaft 53 is driven, and the overriding clutch 69 drives the disc 52. As the disc 52 rotates, the stub shaft 54 also rotates counterclockwise in FIG. 4, thereby causing the knife 56 to coil the spring 57 until the lower edge of the knife clears the cam 65. At this time, the motion of the disc 52 and the force of the spring cause the blade 60 to whip about the shaft 54, thereby snap-cutting the tube 24 in a clean cut.

After the free end of the tube is severed, it drops away, and the photocell 41A opens. However, current continues to feed to the coil of the timer 81 through the contacts 82, 84. After the disc 52 has rotated approximately 200° , the timer times out, thereby actuating (opening) the contacts 84 and de-energizing the coil 81. Immediately, the contacts 83 open, thereby de-energizing the motor 75, and braking is applied immediately. The disc 52 does not, however, stop immediately. Because of the overriding clutch 69, it continues to rotate until the blade 56 engages the stop cam 65, at which time the cutter is returned to its initial position, and ready for a second cycle. The portion of the tube which has been severed, of course, falls to a collection bin, thereby returning the sensor plate 35 to its original position, ready to resume operation.

Having thus described in detail a preferred embodiment of the invention, persons skilled in the art will be able to modify certain of the structure which has been illustrated and to substitute equivalent elements for those disclosed while continuing to practice the principle of the invention, and it is, therefore intended that all such modifications and substitutions be covered as they are embraced within the spirit and scope of the appended claims.

I claim:

1. In apparatus for cutting paper tubes of small diameter including means for moving formed tubes through a cutting station, the improvement comprising: free-hanging sensor means adapted to be moved by the distal free end of a tube after passing through said cutting station; means responsive to the movement of said sensor means for generating a signal; cutter means including a knife adapted to swing through an orbit to sever said tube at said cutter station; and timer means responsive to said signal for actuating said cutter means for one cycle of operation, said cutter means comprising a shaft, a disc mounted on said shaft, a stub shaft mounted on said disc, said knife being rotatably mounted on said stub shaft, spring means mounted on said stub shaft for preloading said knife, and means for stopping said knife at a predetermined position in said orbit, prior to severing said tube, whereby said spring will be wound when said disc is rotated prior to release of said knife in cutting said tube.

2. The apparatus of claim 1 further comprising a directional overriding clutch having an output connected to said disc and an input connected to said shaft; means for driving the input of said clutch, said drive means being actuated by said timer means for a time shorter than a complete cycle time of said cutter means, whereby said clutch permits said disc to override said input thereof to return to its initial position.

3. The apparatus of claim 2 wherein said means for stopping said knife includes a cam adapted to engage said knife at said initial position.

4. In apparatus for cutting paper tubes of small diameter including means for moving formed tubes through a cutting station, the improvement comprising: free-hanging sensor means adapted to be moved by the distal free end of a tube after passing through said cutting station; means responsive to the movement of said sensor means for generating a signal; cutter means including a knife adapted to swing through an orbit to sever said tube at said cutter station; and timer means responsive to said signal for actuating said cutter means for one cycle of operation, said sensor means comprising a plate extending transverse of the axial direction of said tube and having an area greater than the normal travel variation of said tube, said plate including a flag extending in the direction of axial movement of said tube.

5. The apparatus of claim 4 wherein said signal-generating means includes means for generating a beam of light; means for sensing said beam of light, said beam of light being arranged to be interrupted by said tail of said sensor plate when said sensor plate is moved by the travel of said tube beyond a predetermined point.

* * * * *